US011334005B2

(12) United States Patent
Miyake

(10) Patent No.: US 11,334,005 B2
(45) Date of Patent: May 17, 2022

(54) TILTABLE STEERING ASSEMBLY TO ADJUST POSITION OF ENDLESS BELT IN IMAGING SYSTEM

(71) Applicant: HEWLETT-PACKARD DEVELOPMENT COMPANY, L.P., Spring, TX (US)

(72) Inventor: Koji Miyake, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/292,336

(22) PCT Filed: Nov. 20, 2019

(86) PCT No.: PCT/US2019/062409
§ 371 (c)(1),
(2) Date: May 7, 2021

(87) PCT Pub. No.: WO2020/146052
PCT Pub. Date: Jul. 16, 2020

(65) Prior Publication Data

US 2022/0004123 A1 Jan. 6, 2022

(30) Foreign Application Priority Data

Jan. 11, 2019 (JP) ..... JP2019-003575

(51) Int. Cl.
*G03G 15/16* (2006.01)

(52) U.S. Cl.
CPC ..... *G03G 15/161* (2013.01)

(58) Field of Classification Search
CPC ..... G03G 15/161; G03G 15/1615
USPC ..... 399/101, 302
See application file for complete search history.

(56) References Cited

U.S. PATENT DOCUMENTS

| | | | | |
|---|---|---|---|---|
| 5,845,174 | A | 12/1998 | Yasui et al. | |
| 8,447,212 | B2 | 5/2013 | Funamoto et al. | |
| 10,114,316 | B2 * | 10/2018 | Mizuno | G03G 15/1615 |

FOREIGN PATENT DOCUMENTS

| | | | |
|---|---|---|---|
| JP | 2001075449 | | 3/2001 |
| JP | 2004226685 | | 8/2004 |
| JP | 2004271746 | A | 9/2004 |
| JP | 2009210933 | | 9/2009 |
| JP | 2010230817 | | 10/2010 |
| JP | 2011170081 | A | 9/2011 |
| JP | 2014178505 | | 9/2014 |

* cited by examiner

*Primary Examiner* — William J Royer
(74) *Attorney, Agent, or Firm* — Staas & Halsey LLP

(57) ABSTRACT

An imaging system includes an endless belt which includes a first surface and a second surface and a steering assembly which is tiltable to adjust a position of the endless belt. The steering assembly includes a first member that is adjacent to the first surface of the endless belt and a second member that is adjacent to the second surface of the endless belt, to press the endless belt against the first member.

15 Claims, 12 Drawing Sheets

TILTABLE STEERING ASSEMBLY TO ADJUST POSITION OF ENDLESS BELT IN IMAGING SYSTEM

CROSS REFERENCE TO RELATED APPLICATIONS

This application is filed under 35 U.S.C. § 371 as a National Stage of PCT International Application No. PCT/US2019/062409, filed on Nov. 20, 2019, in the U.S. Patent and Trademark Office, which claims the priority benefit of Japanese Patent Application No. 2019-003575, filed on Jan. 11, 2019, in the Japan Patent Office. The disclosures of PCT International Application No. PCT/US2019/062409 and Japanese Patent Application No. 2019-003575 are incorporated by reference herein in their entireties.

BACKGROUND

In some imaging systems, an endless belt is used as an intermediate transfer belt for secondarily transferring toner. A position of the endless belt is adjusted by a steering roller.

DETAILED DESCRIPTION

Figure 1:
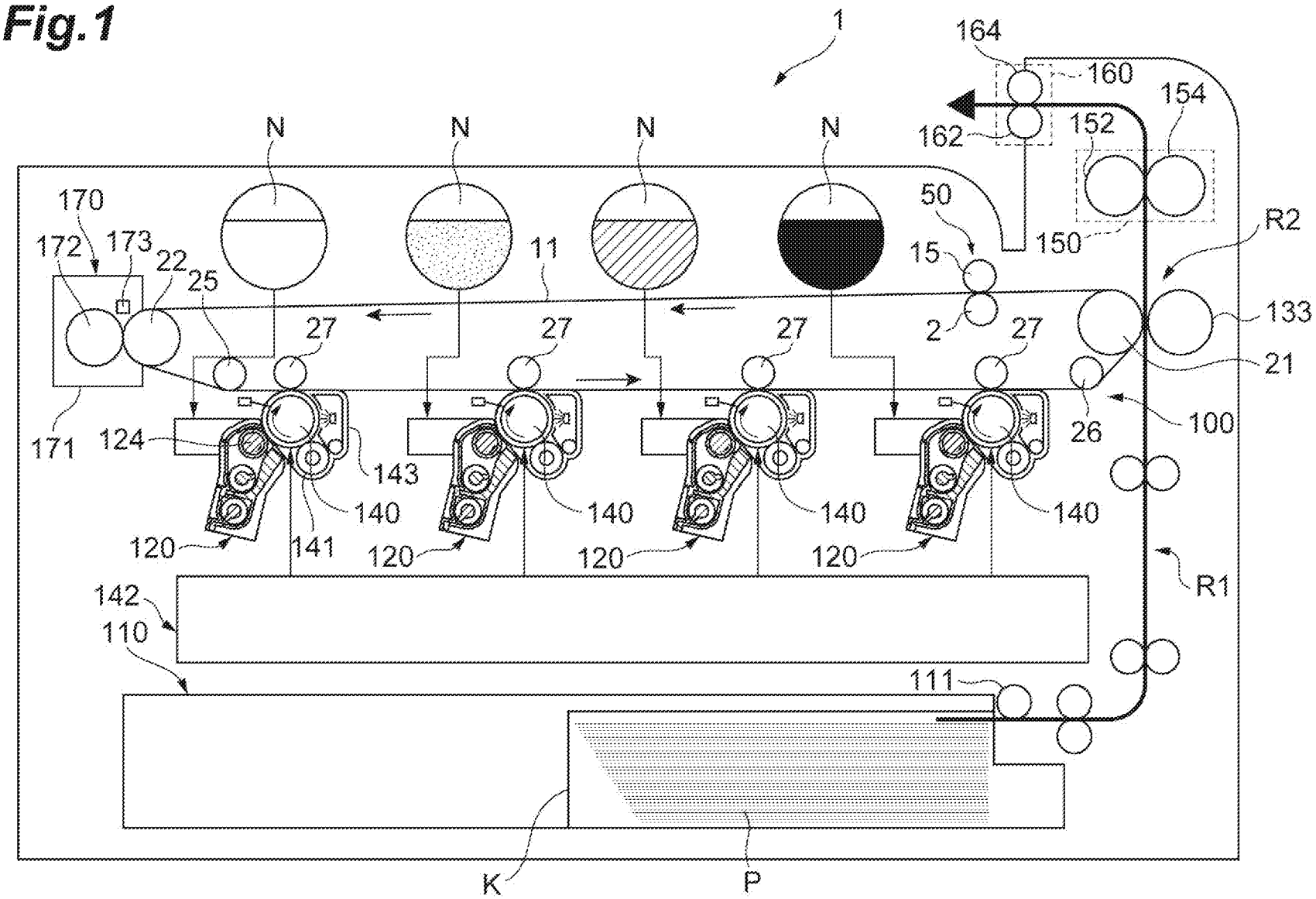
FIG. 1 is a cross-sectional view illustrating a schematic configuration of an example image forming apparatus.

An imaging system may be an image forming apparatus such as a printer or a part (for example, a belt driving device or a steering device for adjusting a position of a transfer belt) of an image forming apparatus. In the following description, with reference to the drawings, the same reference numbers are assigned to the same components or to similar components having the same function, and overlapping description is omitted. In the description, an XYZ coordinate system includes X, Y, and Z directions as illustrated in the drawings. In addition, an end side may refer to an edge or an outer side when the X direction is set as a width direction, and a center may refer to a portion between opposing edges. Further, the X direction may be referred to herein as a left-to-right direction, the Y direction may be referred to as a front-to-rear direction, and the Z direction may be referred to as an up-to-down direction.

With reference to FIG. 1, an example image forming apparatus 1 may form a color image by using four colors, including magenta, yellow, cyan, and black. The image forming apparatus 1 may include a conveying device 110 which conveys a sheet P corresponding to a recording medium, a developing device 120 which develops an electrostatic latent image, a belt driving device 100 which functions as a transfer device that secondarily transfers a toner image onto the sheet P, an image carrier 140 which forms an electrostatic latent image on a surface (a peripheral surface), a fixing 25 device 150 which fixes a toner image to the sheet P, and a discharge device 160 which discharges the sheet P.

The conveying device 110 may convey the sheet P corresponding to a recording medium having an image formed thereon on a conveying route R1. The sheets P may be stacked and stored in a cassette K to be picked up and conveyed by a feeding roller 111. The conveying device 110 allows the sheet P to reach a transfer nip portion R2 through the conveying route R1 at a timing at which the toner image transferred to the sheet P reaches the transfer nip portion R2.

One developing device 120 may be provided for each color. Each developing device 120 includes a developer carrier 124 which carries toner on the image carrier 140. In the developing device 120, two-component developer including carrier, toner, and external additives may be used as developer. In the developing device 120, the developer is adjusted by mixing the carrier, the toner, and the external additives. By this adjustment, the carrier is positively charged and the toner is negatively charged. Further, the external additives are mainly attached to the surface of the toner.

The developing device 120 may carry developer on the developer carrier 124. When the developer is conveyed to a region facing (or adjacent) the image carrier 140 by the rotation of the developer carrier 124, the toner of the developer carried on the developer carrier 124 may move to an electrostatic latent image formed on a peripheral surface of the image carrier 140. By the movement of the toner, the electrostatic latent image is developed and the toner image is formed.

The belt driving device 100 may convey the toner image formed by the developing device 120 to the transfer nip portion R2. The belt driving device 100 may include a transfer belt (e.g., an endless belt) 11 onto which a toner image is primarily transferred from the image carrier 140, a drive roller (a first belt roller) 21 which is a tension roller for tensioning the transfer belt 11, a tension roller (a second belt roller) 22, idle rollers 25 and 26, and a primary transfer roller 27 which sandwiches the transfer belt 11 against the image carrier 140. Additionally, the example image forming apparatus 1 may include a secondary transfer roller 133 which sandwiches the transfer belt 11 along with the tension roller 22. In some examples, the secondary transfer roller 133 sandwiches the transfer belt 11 against the drive roller 21.

The transfer belt 11 may be an endless belt which moves in a circulating manner while being tensioned by the drive roller 21, the tension roller 22, and the idle rollers 25 and 26. The drive roller 21, the tension roller 22, and the idle rollers 25 and 26 are rollers which are rotatable about respective rotational axes. In some examples, each of the tension roller 22 and the idle rollers 25 and 26 is a driven roller which rotates in a driven manner by the rotational driving of the drive roller 21. The primary transfer roller 27 is provided to press against the image carrier 140 from the inner peripheral side of the transfer belt 11. In some examples, the secondary transfer roller 133 is disposed in parallel to the tension roller 22 with the transfer belt 11 interposed therebetween and is provided to press the tension roller 22 from the outer peripheral side of the transfer belt 11. In some examples, the secondary transfer roller 133 is disposed in parallel to the drive roller 21 with the transfer belt 11 interposed between the secondary transfer roller 133 and the drive roller 21, to press the transfer belt 11 against the drive roller 21 from the outer peripheral side of the transfer belt 11. Accordingly, the secondary transfer roller 133 forms the transfer nip portion R2 between the secondary transfer roller 133 and the transfer belt 11.

The image carrier 140 may include an electrostatic latent image carrier, such as a photosensitive drum for example, having a peripheral surface on which an image is formed. The image carrier 140 may be formed as an Organic Photo Conductor (OPC). The example image forming apparatus 1 may be capable of forming a color image. One image carrier 140 may be provided for each color. The image carriers 140 are arranged along the movement direction of the transfer belt 11. The image carrier 140 is formed in, for example, a cylindrical shape. The developing device 120, a charging roller 141, an exposure device 142, and a cleaning device 143 may be provided along the circumference of the image carrier 140.

The charging roller 141 may uniformly charge a surface of the image carrier 140 to a predetermined potential. The charging roller 141 may rotate to follow the rotation of the image carrier 140. The exposure device 142 may expose the surface of the image carrier 140 charged by the charging roller 141 in response to an image formed on the sheet P. Accordingly, a potential of a portion exposed by the exposure device 142 in the surface of the image carrier 140 may change, so that an electrostatic latent image is formed. Four developing devices 120 may generate a toner image by developing the electrostatic latent image formed on the image carrier 140 using the toner supplied from respective toner tanks N located adjacent the respective developing devices 120. The toner tanks N may contain toners of magenta, yellow, cyan, and black toners, respectively. The cleaning device 143 may collect the toner remaining on the image carrier 140 after the toner image formed on the image carrier 140 is primarily transferred onto the transfer belt 11.

The fixing device 150 allows the sheet P to pass through a fixing nip portion for heating and pressing the sheet so that the toner image secondarily transferred from the transfer belt 11 onto the sheet P is fixed to the sheet P. The fixing device 150 includes a heating roller 152 which heats the sheet P and a pressing roller 154 which rotationally drives the heating roller 152 in a pressed state. Each of the heating roller 152 and the pressing roller 154 is formed in a cylindrical shape and the heating roller 152 includes a heat source such as a halogen lamp provided therein. A fixing nip portion which is a contact region is provided between the heating roller 152 and the pressing roller 154 and the toner image is melted and fixed to the sheet P when the sheet P passes through the fixing nip portion.

The discharge device 160 includes discharge rollers 162 and 164 which discharge the sheet P to which the toner image is fixed by the fixing device 150 to the outside of the image forming apparatus 1.

The example image forming apparatus 1 may include a cleaning device 170 located at a downstream position in relation to a steering assembly 50, in the movement direction of the transfer belt 11. The example cleaning device 170 may include a casing 171 which is opened toward the transfer belt 11 and a cleaning member 172 that is provided inside the casing 171. The cleaning member 172 is operable to contact the surface of the transfer belt 11. The transfer belt 11 may be sandwiched by the cleaning member 172 and the tension roller 22. The cleaning member 172 removes the toner remaining on the surface of the transfer belt 11. The cleaning device 170 may be an electrostatic cleaning device. In some examples, the cleaning member 172 may include a cleaning brush for removing the toner. The cleaning brush may include a brush roller or a sponge roller. In some examples, the cleaning member 172 may include a cleaning blade.

The example cleaning device 170 may include a voltage application device 173 that applies a bias voltage of a polarity opposite to the toner remaining on the surface of the transfer belt 11, to remove the toner from the surface of the transfer belt 11 by the bias voltage.

When an image signal of a recording target image is input to the example image forming apparatus 1, the feeding roller 111 may rotate so that the sheets P stacked in the cassette K are conveyed in the image forming apparatus 1. Then, the surface of the image carrier 140 may be uniformly charged to a predetermined potential by the charging roller 141 (a charging operation). Subsequently, the surface of the image carrier 140 is irradiated with a laser beam by the exposure device 142 on the basis of the received image signal, so that an electrostatic latent image is formed (an exposing operation).

The developing device 120 may develop the electrostatic latent image of the image carrier 140, so that a toner image is formed on the image carrier 140 (a developing operation). The toner image is primarily transferred from the image carrier 140 to the transfer belt 11 in a region in which the image carrier 140 faces the transfer belt 11 (a transferring operation). The toner images formed on four image carriers 140 are sequentially layered or superimposed on the transfer belt 11, so that one composite toner image is formed. Then, the composite toner image is secondarily transferred to the sheet P conveyed from the conveying device 110 in the transfer nip portion R2 in which the drive roller 21 faces the secondary transfer roller 133.

The sheet P onto which the composite toner image is secondarily transferred is conveyed to the fixing device 150. Then, the fixing device 150 heats and presses the sheet P between the heating roller 152 and the pressing roller 154 when the sheet P passes through the fixing nip portion. Accordingly, the composite toner image is melted and fixed to the sheet P (a fixing operation). Then, the sheet P is discharged to the outside of the image forming apparatus 1 by the discharge rollers 162 and 164.

Figure 2:
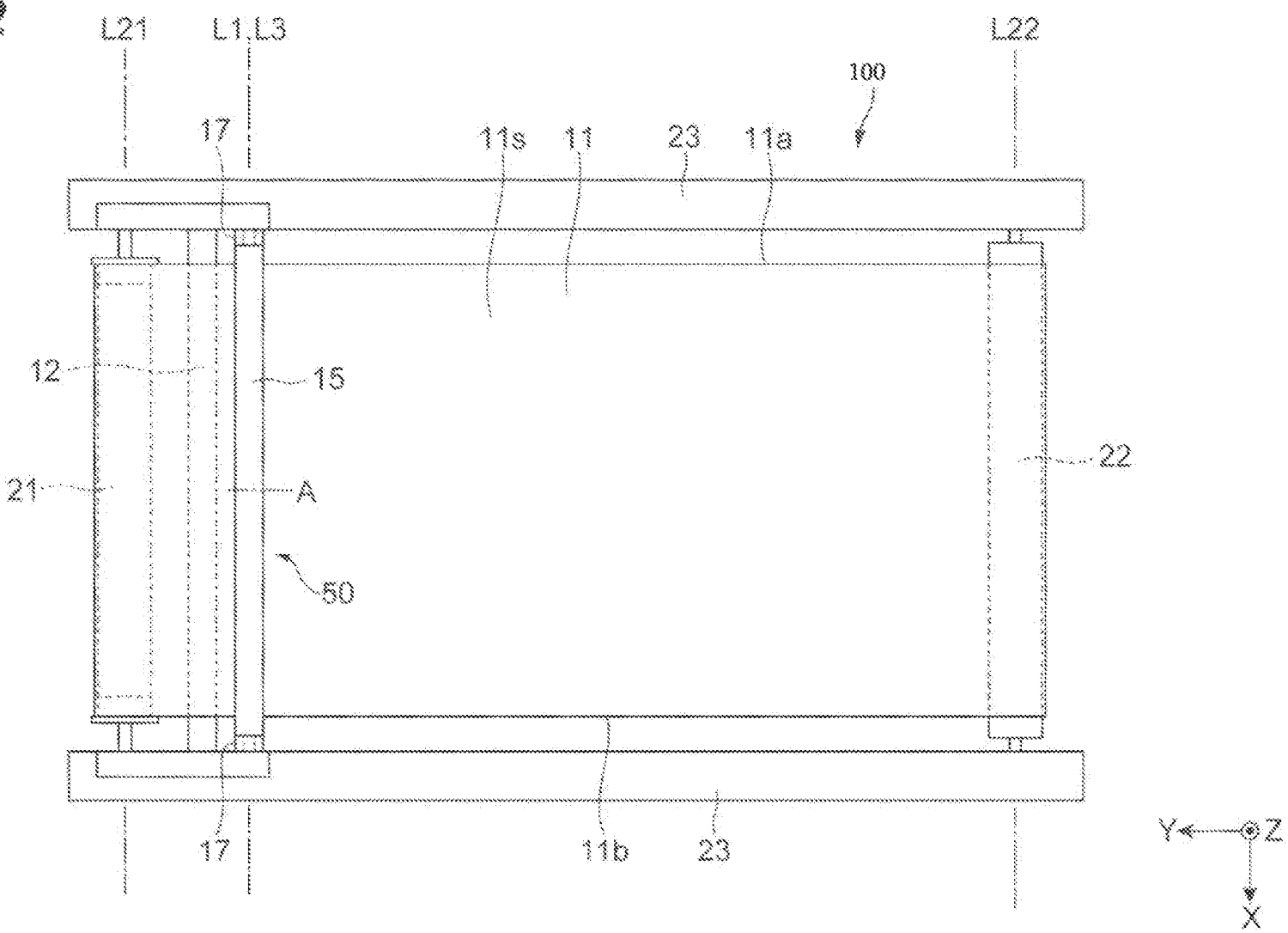
FIG. 2 is a schematic plan view illustrating an example belt driving device.
Figure 3:
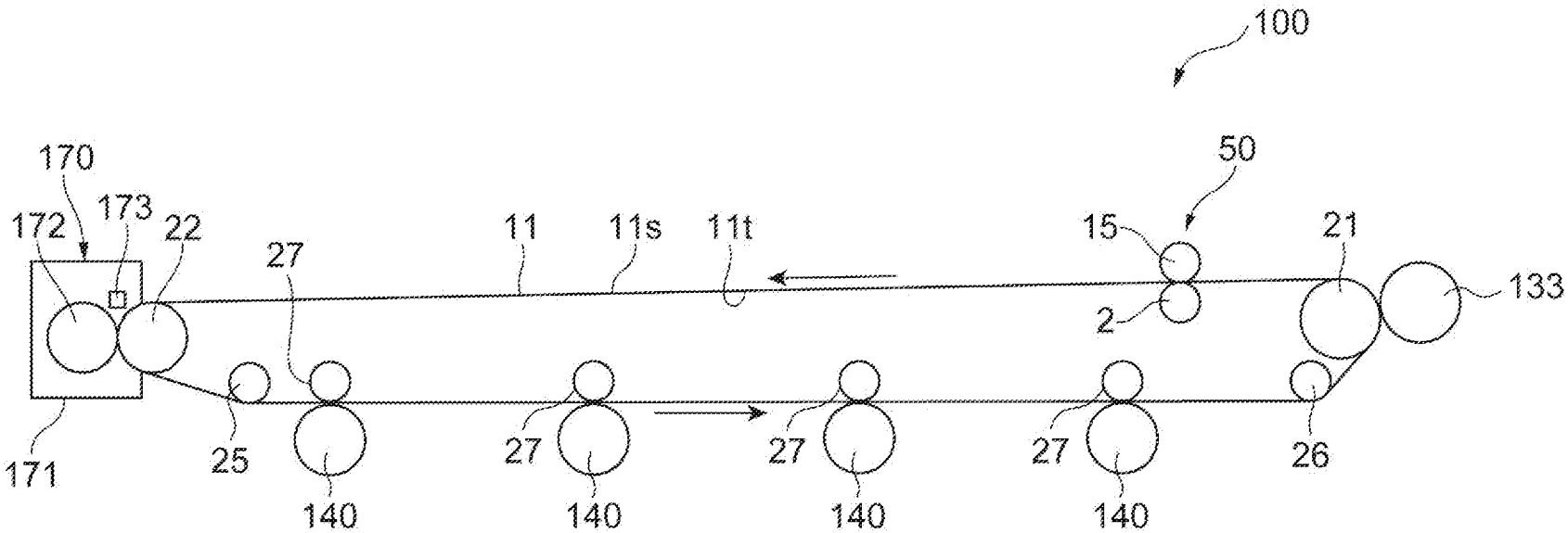
FIG. 3 is a schematic side view illustrating an example belt driving device.

FIGS. 2 and 3 are schematic views of the example belt driving device 100, in which some components or features are omitted for easier understanding of the drawings. With reference to FIGS. 2 and 3, the belt driving device 100 includes the transfer belt 11, the drive roller (the first belt roller) 21, the tension roller (the second belt roller) 22, the idle rollers 25 and 26, the primary transfer roller 27, and the steering assembly 50.

The transfer belt 11 is an endless belt and includes an inner peripheral surface (e.g., a first surface) 11*t* and an outer peripheral surface (e.g., a second surface) 11*s* opposite to the inner peripheral surface lit. That is, the inner peripheral surface 11*t* faces the inside of the annular transfer belt 11 and the outer peripheral surface 11*s* faces the outside of the annular transfer belt 11. The toner image (the toner) is transferred from the image carrier 140 to the outer peripheral surface 11*s* of the transfer belt 11. The transfer belt 11 includes, at opposite sides in the X direction, a first end edge 11*a* (also referred to as first edge 11*a*) and a second end edge 11*b* (also referred to as second edge 11*b*) opposite the first end edge 11*a*. The first end edge 11*a* and the second end edge 11*b* extend in the Y direction. The transfer belt 11 is tensioned by the drive roller 21, the tension roller 22, and the idle rollers 25 and 26. The transfer belt 11 moves along the circumferences of the drive roller 21, the tension roller 22, and the idle rollers 25 and 26.

The drive roller 21 extends in the X direction. The drive roller 21 is rotatable about an axis L21 extending in the X direction. The drive roller 21 may have a cylindrical shape. The drive roller 21 may rotate by receiving power from an electric motor (not illustrated).

The tension roller 22 extends in the X direction. The tension roller 22 is disposed to be spaced apart from the drive roller 21 in the Y direction. The tension roller 22 is rotatable about an axis L22 extending in the X direction. The tension roller 22 may have a cylindrical shape. The tension roller 22 rotates in a driven manner as the transfer belt 11 moves. The tension roller 22 may be biased away from the drive roller 21 by an elastic member such as a coil spring disposed in the front-to-rear direction. For example, a tension system which applies a tension to the transfer belt 11 may be configured by rollers including the drive roller 21 and the tension roller 22.

With reference to FIG. 3, the idle rollers 25 and 26 extend in the X direction. The idle roller 25 is disposed near the drive roller 21 and the idle roller 26 is disposed near the tension roller 22. The idle rollers 25 and 26 are disposed at the lower side in relation to the drive roller 21 and the tension roller 22.

Four primary transfer rollers 27 are disposed between the idle rollers 25 and 26 and spaced apart from one another in the Y direction.

With reference to FIG. 2, the example belt driving device 100 may include a pair of frames 23, extending in the Y direction, and spaced apart from each other in the X direction. The pair of frames 23 may rotatably support the drive roller 21 and the tension roller 22. The primary transfer roller 27 and the idle rollers 25 and 26 may be also supported by the pair of frames 23.

Figure 4:
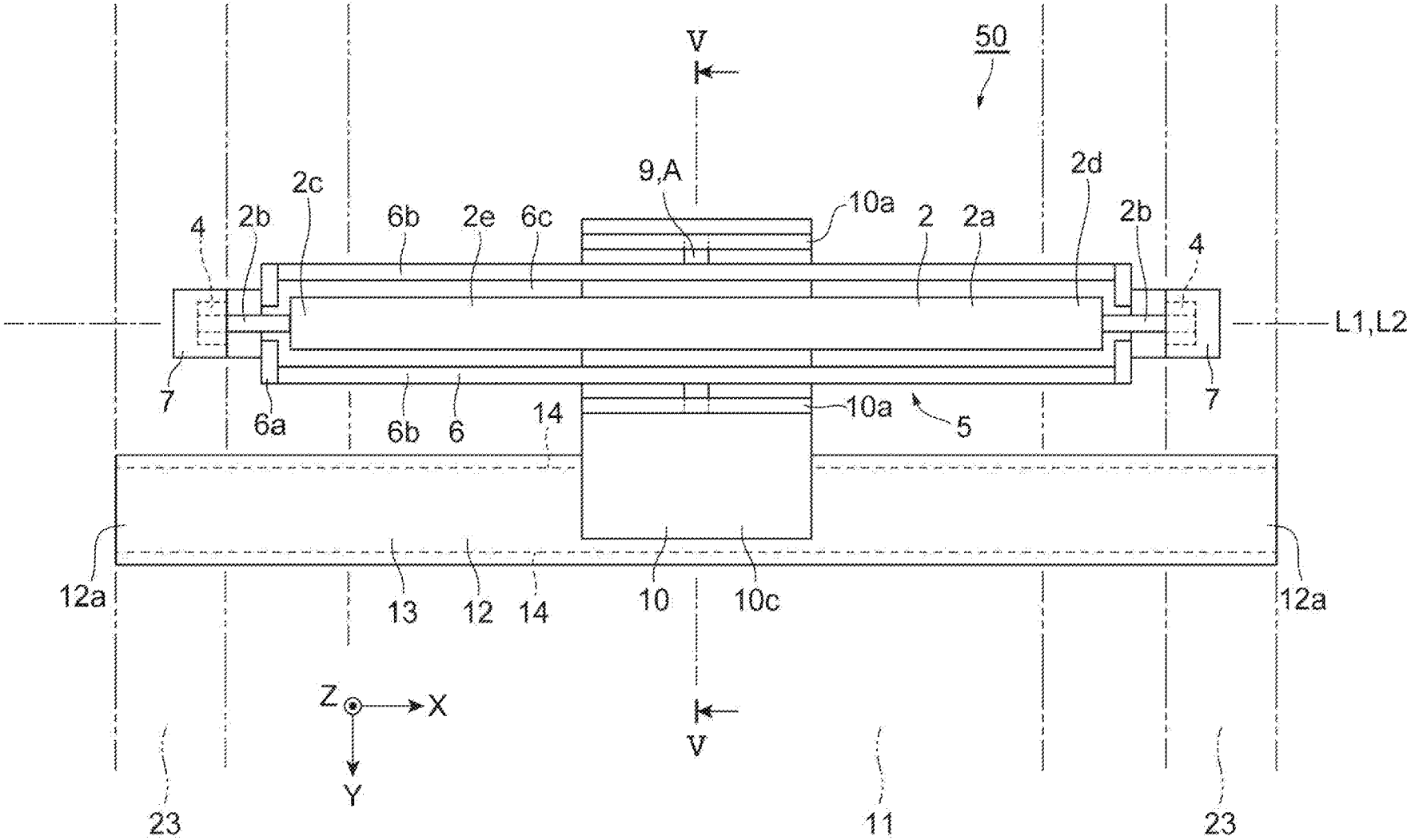
FIG. 4 is a plan view illustrating an example steering assembly.
Figure 5:
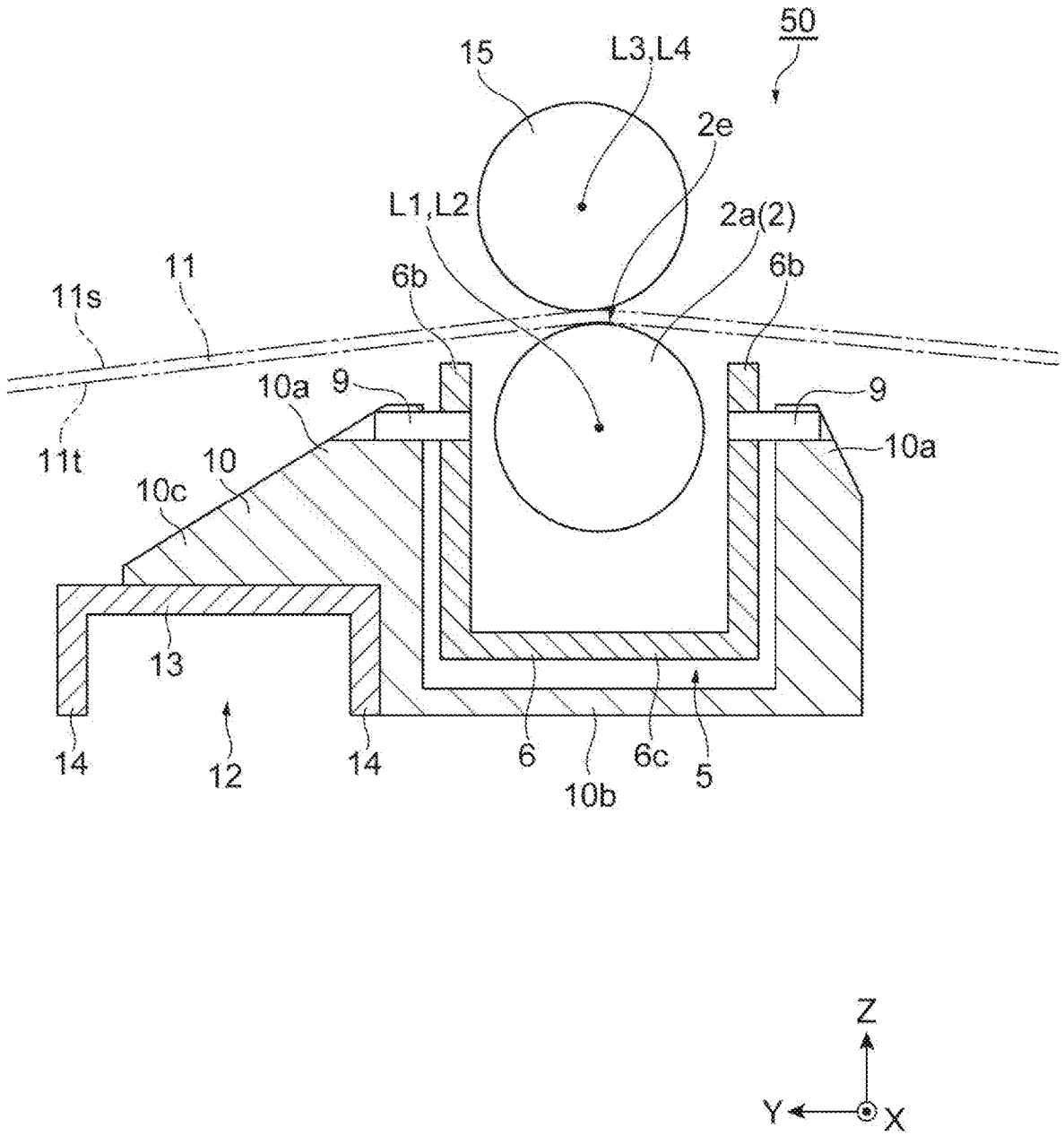
FIG. 5 is a cross-sectional view of the example steering assembly illustrated in FIG. 4, taken along line V-V.
Figure 6:
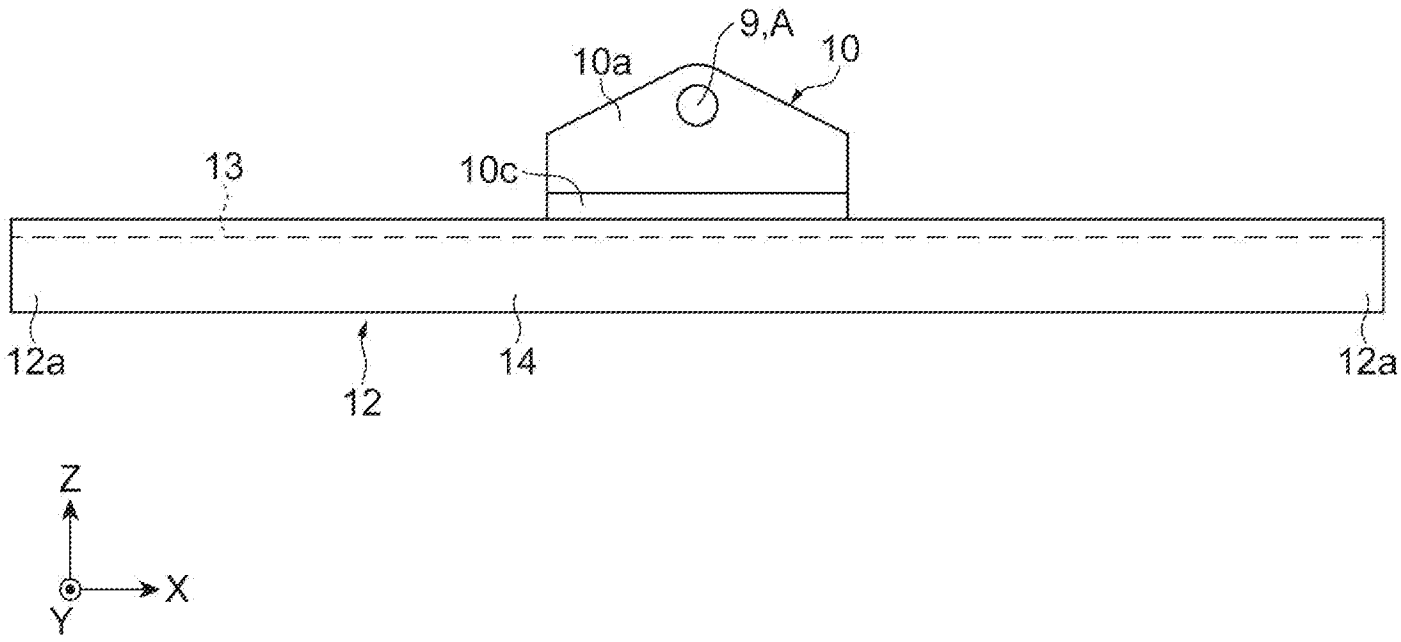
FIG. 6 is a front view illustrating a pivot shaft holding member and a connection member according to an example.
Figure 7:
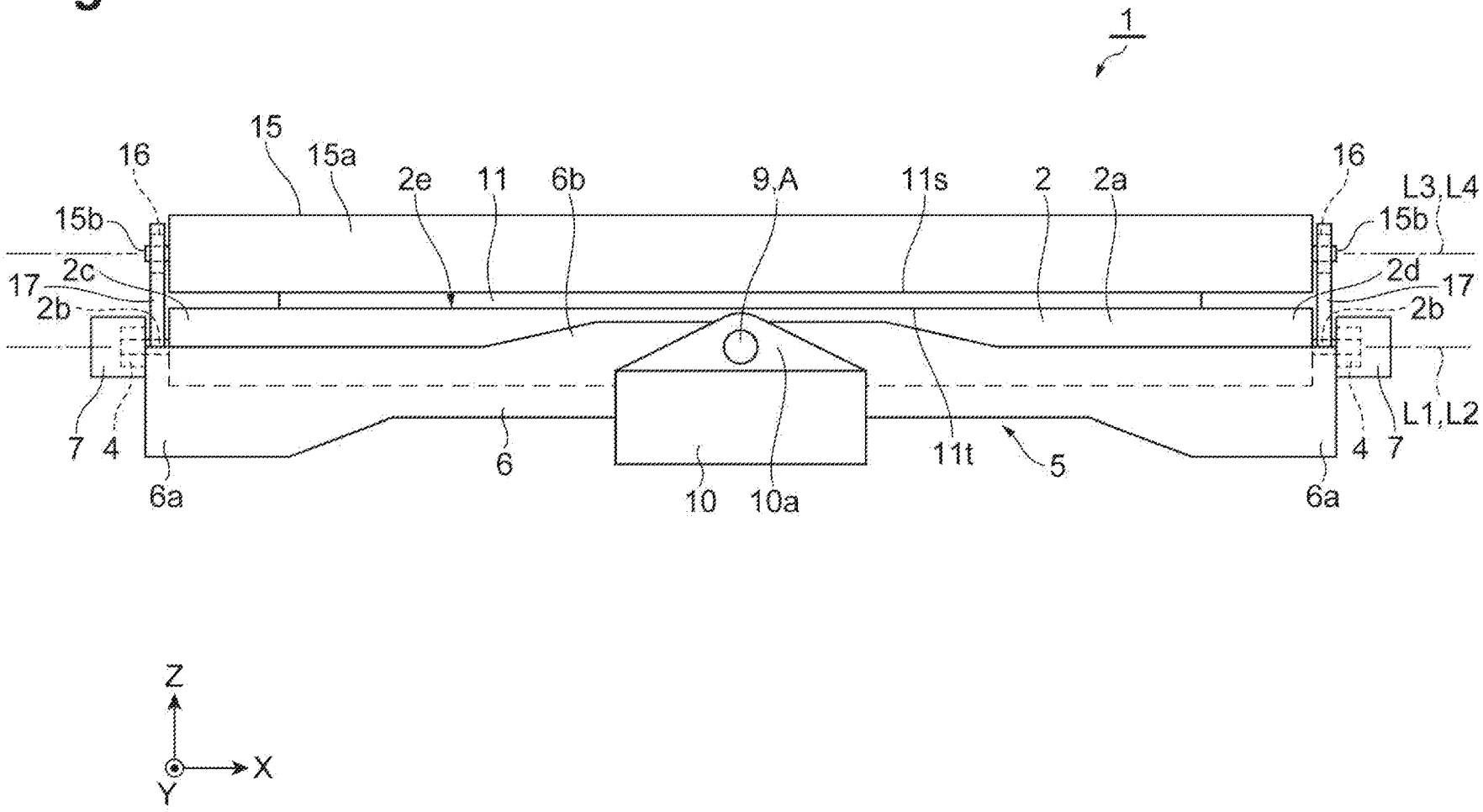
FIG. 7 is a front view illustrating an example steering assembly.

An example steering assembly 50 is illustrated in FIGS. 4 and 5, in which some components or features are omitted. For example, a pressing roller 15 is omitted in FIG. 4. FIG. 6 is a front view illustrating an example pivot shaft holding member 10 and a connection member 12. FIG. 7 is a front view illustrating an example steering assembly 50. Some components or features may be omitted from FIGS. 6 and/or 7. For example, a connection member 12 is omitted in FIG. 7. The example steering assembly 50 may be tiltable to adjust the position of the transfer belt 11. The steering assembly 50 includes the steering roller (e.g., the first member) 2, the pressing roller (e.g., the second member, the roller, and the pressing member) 15, a roller holding member 5, the pivot shaft holding member 10, and the connection member 12. The steering assembly 50 can change the position of the transfer belt 11 in the X direction by applying an increased tension along the first end edge 11*a* of the endless belt 11.

An example steering roller 2 may be disposed inside the annular transfer belt 11, adjacent to the inner peripheral surface 11*t* of the transfer belt 11. The steering roller 2 is disposed between the drive roller 21 and the tension roller 22 in the Y direction. The steering roller 2 may be disposed at a position close to the drive roller 21 in relation to the center in the Y direction. The steering roller 2 may be disposed at a position close to the tension roller 22 in relation to the center in the Y direction. An axis L1 of the steering roller 2 is disposed at a position higher than the axis L21 of the drive roller 21 in the Z direction. The steering roller 2 may be arranged to contact the transfer belt 11.

The steering roller 2 may include a roller body 2*a* and a pair of small diameter portions 2*b*. The small diameter portion 2*b* extends outward from the roller body 2*a* in a longitudinal direction L2 of the steering roller 2. Each of the roller body 2*a* and the small diameter portion 2*b* may have a cylindrical shape. The outer diameter of the small diameter portion 2*b* is smaller than the outer diameter of the roller body 2*a*. The roller body 2*a* and the small diameter portion 2*b* are formed coaxially.

The steering roller 2 is supported by a pair of bearings 4 to be rotatable about the axis L1. The axis L1 is an imaginary line which extends along the longitudinal direction L2 of the steering roller 2. The bearing 4 rotatably supports both end portions of the steering roller 2 in the longitudinal direction L2. The bearing 4 may be a cylindrical sleeve, in some examples. The bearing 4 may have another structure. The bearing 4 includes a surface to contact the outer peripheral surface of the small diameter portion 2*b*.

The roller holding member 5 may hold the steering roller 2 and the pressing roller 15. The roller holding member 5 may include a steering roller holding member body 6 and a pair of bearing holding members 7. The steering roller holding member body 6 extends in the longitudinal direction L2 of the steering roller 2. The bearing holding member 7 may include a cylindrical bearing receiving portion. The bearing 4 of the steering roller 2 is held by the bearing holding member 7. The pair of bearing holding members 7 is attached to both end portions 6*a* of the steering roller holding member body 6. The end portion 6*a* is an end portion of the steering roller 2 in the longitudinal direction L2.

The steering roller holding member body 6 includes a pair of side plates 6*b* that face each other in the Y direction. The plate thickness direction of the side plate 6*b* may include a direction along the Y direction. The steering roller holding member body 6 may include a bottom plate 6*c* extending in the longitudinal direction L2 of the steering roller 2 and connecting the pair of side plates 6*b*. The plate thickness direction of the bottom plate 6*c* follows the Z direction. The steering roller 2 is disposed inside a space which is surrounded by the pair of side plates 6*b* and the bottom plate 6*c*. A part of an outer peripheral surface 2*e* of the steering roller 2, in the circumferential direction of the steering roller 2, is exposed to an outside of steering roller holding member body 6. For example, an upper portion in the outer peripheral surface 2*e* of the steering roller 2, in relation to the side plate 6*b*, may be exposed to the outside such that the steering roller 2 may contact the transfer belt 11. The side plate 6*b* may be provided with a pivot shaft 9 that extends in the Y direction. The pivot shaft 9 may have a cylindrical shape and constitute a fulcrum A.

The pivot shaft holding member 10 may rotatably support the pivot shaft 9. The pivot shaft holding member 10 may include a pair of side portions 10*a* which face each other in the Y direction. The pair of side portions 10*a* is disposed at the outside of the steering roller holding member body 6 in the Y direction. For example, the steering roller holding member body 6 is disposed between the pair of side portions 10*a*. The side portion 10*a* faces the side plate 6*b* in the Y direction. The side portion 10*a* is provided with a bearing portion which rotatably supports the pivot shaft 9. The bearing portion may be, for example, a through-hole. The steering roller 2 is swingable (tiltable) about the fulcrum A by using the pivot shaft 9 as the fulcrum A.

The pivot shaft holding member 10 may include a bottom portion 10*b*. The bottom portion 10*b* may be formed to be divided in the Y direction. The bottom portion 10*b* extends from the lower side of the side portion 10*a* in the Y direction. The bottom portion 10*b* faces the bottom plate 6*c* in the Z direction. The bottom portion 10*b* is disposed at a side opposite to the steering roller 2 with respect to the bottom plate 6*c*.

The pivot shaft holding member 10 may include a protrusion portion 10*c* which protrudes from one side portion 10*a*. In some examples, the protrusion portion 10*c* may protrude toward the drive roller 21 in the Y direction.

The connection member 12 may extend in the X direction to connect the pivot shaft holding member 10 and the frame 23. The connection member 12 may be disposed between the drive roller 21 and the steering roller 2 in the Y direction. The connection member 12 may include a plate portion 13 and a pair of side plates 14. The plate thickness direction of the plate portion 13 follows the Z direction. The pair of side plates 14 is disposed to be separated from each other in the Y direction. The plate thickness direction of the side plate 14 faces the Y direction. The pair of side plates 14 protrudes downward from the plate portion 13. The protrusion portion 10*c* of the pivot shaft holding member 10 is attached to the surface of the plate portion 13. A lower end portion of the side portion 10*a* of the pivot shaft holding member 10 may contact the side plate 14 in the Y direction. The pivot shaft holding member 10 is fixed to the connection member 12 and is movable together with the connection member 12. An end portion 12*a* of the connection member 12 in the longitudinal direction may be supported by the frame 23.

With reference to FIGS. 5 and 7, the pressing roller 15 is located at the outside of the annular transfer belt 11 and faces the steering roller 2 with the transfer belt 11 interposed therebetween. The pressing roller 15 may include a sponge roller, a solid rubber roller, a metal roller, or the like. The pressing roller 15 is adjacent to the outer peripheral surface 11*s* of the transfer belt 11 and presses the transfer belt 11 against the steering roller 2. The pressing roller 15 is disposed between the drive roller 21 and the tension roller 22 in the Y direction. The pressing roller 15 includes a roller body 15*a* and a pair of small diameter portions 15*b*. The small diameter portion 15*b* extends from the roller body 15*a* outward in a longitudinal direction L4 of the pressing roller 15. The roller body 15*a* and the small diameter portion 15*b* may have a cylindrical shape. The outer diameter of the small diameter portion 15*b* is smaller than the outer diameter of the roller body 15*a*. The roller body 15*a* and the small diameter portion 15*b* are formed coaxially.

The pressing roller 15 is supported by the pair of bearings 16 to be rotatable about an axis L3. The axis L3 is an imaginary line which extends in the longitudinal direction L4 of the pressing roller 15. The bearing 16 rotatably supports both end portions of the pressing roller 15 in the longitudinal direction L4. The bearing 16 may include a cylindrical sleeve. The bearing 16 may have another structure. The bearing 16 includes a surface which is operable to contact the outer peripheral surface of the small diameter portion 15*b*.

In some examples, the roller holding member 5 includes a pair of pressing roller holding members 17. The pressing roller holding member 17 may include a cylindrical bearing receiving portion. The bearing 16 of the pressing roller 15 is held by the pressing roller holding member 17. The pair of pressing roller holding members 17 is attached to both end portions 6*a* of the steering roller holding member body 6. Accordingly, the pressing roller 15 presses the transfer belt 11 against the steering roller 2 while a relative position with the steering roller 2 is fixed. Further, the pressing roller 15 may be tilted as the steering roller 2 is tilted while a relative position with the steering roller 2 is fixed.

The pressing roller 15 may have conductivity to adjust a charge of the toner remaining on the outer peripheral surface 11*s* of the transfer belt 11. For example, the pressing roller 15 may be grounded and the pressing roller 15 may adjust the charge of the toner while contacting the toner. In some examples, the pressing roller 15 may adjust the charge of the toner by applying a voltage to the toner. For example, the pressing roller 15 may adjust the charge of the toner by applying a voltage of the same polarity as the toner to the toner remaining on the outer peripheral surface 11*s* of the transfer belt 11. Accordingly, the charging of the toner remaining on the outer peripheral surface 11*s* of the transfer belt 11 is strengthened. Since the charging of the toner is strengthened, it is possible to assist an operation of removing the toner from the outer peripheral surface 11*s* when an electrostatic cleaning device is used as the cleaning device 170.

Figure 8:
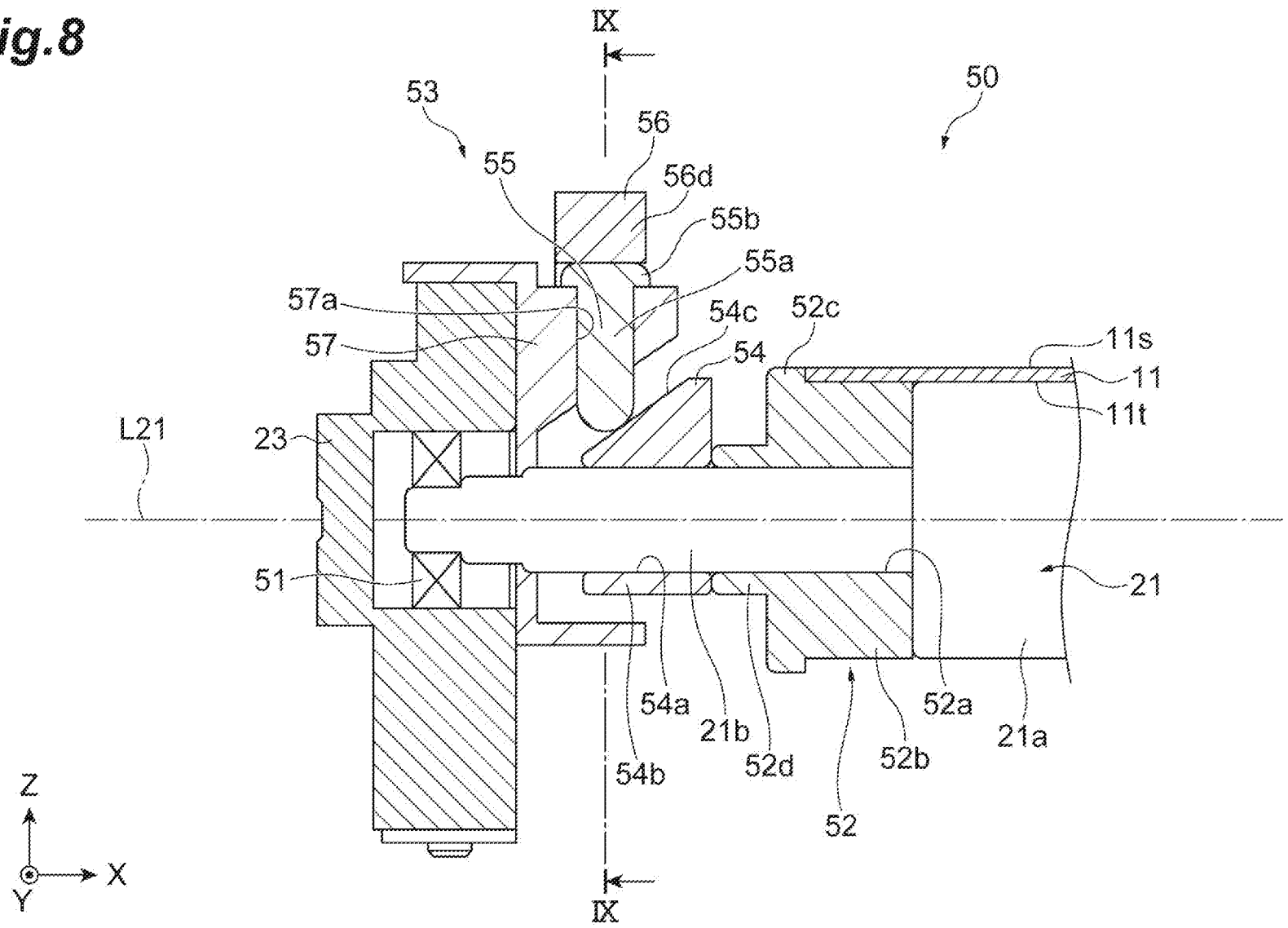
FIG. 8 is a cross-sectional view illustrating an end portion structure of an example steering assembly including a drive roller.

With reference to FIG. 8, the drive roller 21 may include a first belt roller body 21*a* and a small diameter portion 21*b*. The small diameter portion 21*b* protrudes outwardly in the X direction from the end portion of the first belt roller body 21*a*. The length of the transfer belt 11 in the X direction is longer than the length of the first belt roller body 21*a* in the X direction. The transfer belt 11 protrudes outwardly in relation to the first belt roller body 21*a* in the X direction. The belt driving device 100 may include a bearing 51 which rotatably supports the drive roller 21. The bearing 51 may be a cylindrical sleeve or may have another structure.

In some examples, the steering assembly 50 may include a pulley 52 and a link mechanism 53. The pulley 52 may be attached to the drive roller 21, to be movable in the X direction as the transfer belt 11 moves in the X direction.

The pulley 52 is provided with a center opening 52*a*. The small diameter portion 21*b* is insertable through the center opening 52*a*. The pulley 52 includes a main body 52*b*, a flange portion 52*c*, and a small diameter portion 52*d*. The main body 52*b* may have a cylindrical shape. The center opening 52*a* is formed at the center of the main body 52*b*. The outer diameter of the main body 52*b* is substantially the same as the outer diameter of the first belt roller body 21*a*. The outer peripheral surface of the main body 52*b* is operable to contact the inner peripheral surface 11*t* of the transfer belt 11.

In some examples, the flange portion 52*c* protrudes outwardly in relation to the outer peripheral surface of the main body 52*b* in the radial direction. The flange portion 52*c* is formed in the entire circumference of the pulley 52 in the circumferential direction. The flange portion 52*c* is disposed at a side opposite to the first belt roller body 21*a* in the X direction. The flange portion 52*c* may protrude outwardly in relation to the outer peripheral surface 11*s* of the transfer belt 11 in the radial direction. The outer peripheral surface 11*s* of the transfer belt 11 is opposite to the drive roller 21. The inner peripheral surface 11*t* of the transfer belt 11 is a surface at the side of the drive roller 21 and is a surface which is able to contact the drive roller 21. An end surface of the transfer belt 11 is an outer surface in the X direction.

In some examples, the flange portion 52*c* includes a surface which is able to contact the end surface of the transfer belt 11 in the X direction. For example, when the transfer belt 11 is displaced outwardly in the X direction, the end surface of the transfer belt 11 abuts on the flange portion 52*c*. The pulley 52 is slidable in the X direction in response to the displacement of the transfer belt 11.

In some examples, the small diameter portion 52*d* of the pulley 52 protrudes outwardly in relation to the flange portion 52*c* in the X direction. The small diameter portion 52*d* includes a cylindrical portion having a diameter smaller than that of the main body 52*b*. The center opening 52*a* is formed at the center of the small diameter portion 52*d*.

The link mechanism 53 may include a first intermediate member 54, a pin 55, and a second intermediate member 56. The first intermediate member 54 may be attached to the drive roller 21. The first intermediate member 54 may be disposed between the pulley 52 and the bearing 51 in the X direction. When the pulley 52 moves outwardly in the X direction, the first intermediate member 54 is pressed by the pulley 52 to move outward in the X direction. An opening portion 54*a* penetrates the first intermediate member 54 in the X direction. The small diameter portion 21*b* of the drive roller 21 is inserted through the opening portion 54*a*.

The first intermediate member 54 includes a main body 54*b* provided with the opening portion 54*a*. The outer surface of the main body 54*b* is provided with an inclined surface 54*c*. The inclined surface 54*c* is, for example, an upper surface. The inclined surface 54*c* is inclined to be separated from the axis L21 as it goes inward in the X direction from the outside. In other words, the inclined surface 54*c* is inclined to be higher as it goes inward in the X direction from the outside. Accordingly, when the first intermediate member 54 moves outwardly in the X direction, a member contacting the inclined surface 54*c* is pressed upward.

Figure 9:
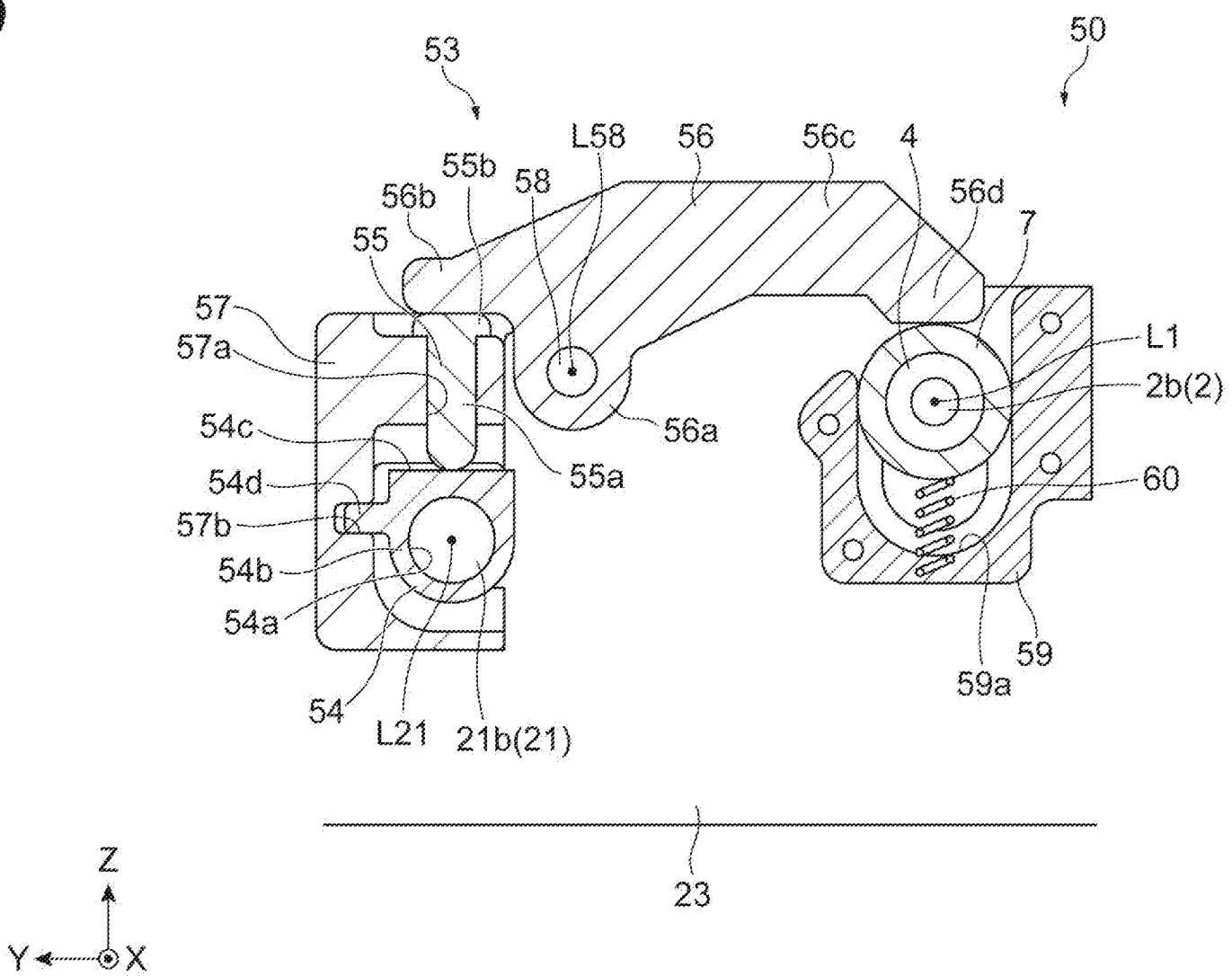
FIG. 9 is a cross-sectional view of the end portion structure illustrated in FIG. 8, taken along line IX-IX.

With reference to FIG. 9, the side portion of the main body 54*b* may be provided with a protrusion piece 54*d* which protrudes outwardly. The protrusion piece 54*d* may have a plate shape and extend continuously in the X direction. The protrusion piece 54*d* is continuous in a direction in which the opening portion 54*a* penetrates. The plate thickness direction of the protrusion piece 54*d* follows the Z direction.

The pin 55 may include a main body 55*a* and a flange portion 55*b*. The main body 55*a* has a cylindrical shape. The flange portion 55*b* protrudes outwardly from the main body 55*a* in a radial direction. The main body 55*a* is disposed along the Z direction. The flange portion 55*b* is formed at the upper end portion of the main body 55*a*. The lower end portion of the main body 55*a* may include a spherical surface.

The link mechanism 53 may include a holding member 57. The holding member 57 is attached to the frame 23. The holding member 57 may include a pin holding portion 57*a* and a first intermediate member guide portion 57*b*. An opening portion penetrates the pin holding portion 57*a* in the Z direction. The pin 55 is inserted through the opening portion. A circumferential edge portion of the opening portion is provided with a surface to contact the flange portion 55*b* of the pin 55. When the flange portion 55*b* contacts the circumferential edge portion of the opening portion, the position of the pin 55 in the Z direction is limited. The flange portion 55*b* abuts on the circumferential edge portion of the opening portion so that the downward movement of the pin 55 is limited.

In some examples, the first intermediate member guide portion 57*b* includes a guide groove which guides the movement of the protrusion piece 54*d* of the first intermediate member 54. The first intermediate member guide portion 57*b* is disposed to face the first intermediate member 54 in the Y direction. A surface of the first intermediate member guide portion 57*b* facing the first intermediate member 54 is provided with a guide groove. The guide groove is continuous in the X direction. The protrusion piece 54*d* of the first intermediate member 54 is inserted into the guide groove. The protrusion piece 54*d* moves along the guide groove so that the movement of the first intermediate member 54 in the X direction is guided.

The second intermediate member 56 may include a fulcrum portion 56*a*, a receiving portion 56*b*, a continuous portion 56*c*, and a pressing portion 56*d*. The second intermediate member 56 is swingable (or pivotable) about the fulcrum portion 56*a* which is a pivot portion. The fulcrum portion 56*a* is provided with an opening portion. A support shaft 58 is inserted through the opening portion. The support shaft 58 may be attached to the frame 23. The support shaft 58 extends in the X direction. The support shaft 58 extends from the frame 23 inward in the X direction. The support shaft 58 is disposed between the drive roller 21 and the steering roller 2 in the Y direction. The fulcrum portion 56*a* is rotatable about the support shaft 58. An axis L58 of the support shaft 58 may be disposed above the axes L21 and L1 in the Z direction.

The receiving portion 56*b* may be connected to the fulcrum portion 56*a* and protrudes outwardly in the Y direction. The receiving portion 56*b* may extend toward the drive roller 21 in the Y direction. The receiving portion 56*b* may be disposed above the fulcrum portion 56*a*. The receiving portion 56*b* may extend to a position in which the receiving portion 56*b* is able to contact the upper end portion of the pin 55. The receiving portion 56*b* may be operable to contact the upper end portion of the pin 55. The receiving portion 56*b* may be displaced as the pin 55 moves in the Z direction. When the pin 55 moves upward, the receiving portion 56*b* moves upward in a synchronization manner.

In some examples, the continuous portion 56*c* is connected to the fulcrum portion 56*a* and extends inward in the Y direction. The continuous portion 56*c* extends toward the side opposite to the receiving portion 56*b* in the Y direction. The continuous portion 56*c* is disposed at the upper side in relation to the fulcrum portion 56*a*. The continuous portion 56*c* extends to the upper side of the bearing holding member 7. The continuous portion 56*c* swings as the fulcrum portion 56*a* rotates. The pressing portion 56*d* is provided at a front end of the continuous portion 56*c*. The pressing portion 56*d* includes a surface which contacts the outer surface of the bearing holding member 7. When the continuous portion 56*c* swings, the pressing portion 56*d* moves downward to press the bearing holding member 7, so that the bearing 4 and thea first end portion 2*c* of the steering roller 2 are pressed downward.

The link mechanism 53 may include a connector 59 connected to the frame 23. The connector 59 may include a receiving portion 59*a* which stores the bearing holding member 7. The connector 59 may include a surface which guides the movement of the bearing holding member 7 in the Z direction. The connector 59 is able to hold a spring member 60. The spring member 60 is disposed along the Z direction and supports the bearing holding member 7 from below. The lower end portion of the spring member 60 is supported by the connector 59. The upper end portion of the spring member 60 is operable to contact the bottom surface of the bearing holding member 7. The spring member 60 moves in a telescopic manner in the Z direction so that the bearing holding member 7 can be biased upward.

In some examples, an end portion near a second end portion 2*d* of the steering roller 2 is provided with a mechanism similar to the link mechanism 53 which presses the first end portion 2*c* of the steering roller 2 downward. Accordingly, the second end portion 2*d* of the steering roller 2 can be pressed downward similarly to the first end portion 2*c* of the steering roller 2.

Figure 10:
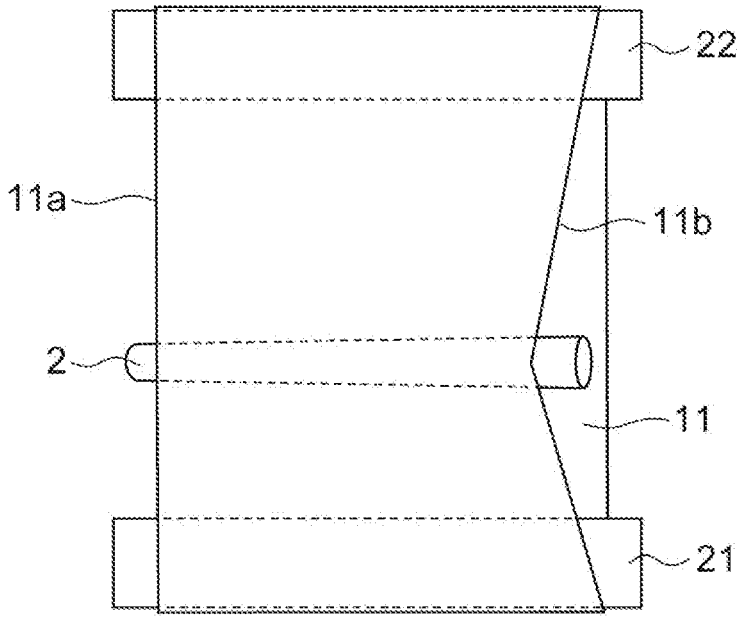
FIG. 10 is a schematic diagram illustrating an operation of the belt driving device.

FIG. 10 illustrates an example in which the transfer belt 11 is displaced to the first end edge 11*a*. The pressing roller 15 is not shown in FIG. 10. In the example belt driving device 100, the displacement of the transfer belt 11 in the width direction is corrected, to prevent a meandering of the transfer belt 11. The transfer belt 11 moves in a circulating manner by power transmitted from the drive roller 21. The tension roller 22 rotates with the movement of the transfer belt 11. The steering roller 2 rotates with the movement of the transfer belt 11.

When the transfer belt 11 is displaced to the outside in the width direction, the end surface of the transfer belt 11 contacts the flange portion 52*c* of the pulley 52 (see FIGS. 8 and 9). When the movement amount of the transfer belt 11 in the width direction increases, the transfer belt 11 presses the pulley 52. When the pulley 52 moves outwardly in the X direction, the pin 55 is pressed upward by the inclined surface 54*c*. When the pin 55 is displaced upward, the receiving portion 56*b* of the second intermediate member 56 is pressed upward so that the second intermediate member 56 swings about the axis L58.

Accordingly, the pressing portion 56*d* is displaced downward so that the bearing holding member 7 is pressed downward. With reference to FIG. 10, the steering roller 2 at the side of the first end edge 11*a* of the transfer belt 11 moves downward so that the steering roller 2 is tilted. Additionally, the pressing roller 15 is also tilted as the steering roller 2 is tilted. That is, the steering roller 2 and the pressing roller 15 are tilted in a direction intersecting the movement direction of the transfer belt 11 (a direction in which the rollers are moved by the rotation of the drive roller 21).

When the steering roller 2 is tilted, the tension of the transfer belt 11 at the side of the first end edge 11*a* decreases and the tension of the transfer belt 11 at the side of the second end edge 11*b* increases. For example, the tension of the transfer belt 11 at the side of the first end edge 11 a becomes lower than the tension of the transfer belt 11 at the side of the second end edge 11*b*. Accordingly, the transfer belt 11 moves toward the second end edge 11*b* in the width direction. As a result, the displacement of the transfer belt 11 is corrected. Additionally, when the tension of the transfer belt 11 at the side of the second end edge 11*b* increases, the tension roller 22 which is biased by an elastic member is pulled toward the drive roller 21 by the increased tension.

When the transfer belt 11 moves toward the second end edge 11*b, a*-forces Gf pressing the pulley 52 outward in the X direction become weak. Accordingly, since the spring member 60 biases the bearing holding member 7 to be pressed upward, the pressing portion 56*d* of the second intermediate member 56 moves upward. By this movement, the receiving portion 56*b* moves downward so that the pin 55 is pressed downward. Since the pin 55 contacting the inclined surface 54*c* moves downward, the first intermediate member 54 moves inward in the X direction. The pulley 52 is pressed back by the first intermediate member 54. Then, the first end portion 2*c* of the steering roller 2 returns to an original position. When the steering roller 2 returns to an original position, the pressing roller 15 also returns to an original position.

In some of the above-described examples of the image forming apparatus 1, the transfer belt 11 is pressed against the steering roller 2 by the pressing roller 15. The pressing roller 15 can allow the transfer belt 11 to uniformly contact the steering roller 2 in the entire region of the transfer belt 11 in the width direction. Further, the pressing roller 15 is tiltable as the steering roller 2 is tilted. Accordingly, the transfer belt 11 is prevented from lifting away from the steering roller 2 when the steering roller 2 is tilted, to improve an adjustment of the position of the transfer belt 11 when tilting the steering roller 2.

In a steering assembly without any pressing roller such as the pressing roller 15, the transfer belt may not contact the steering roller along the entire length of the steering roller 2. For example, for a transfer belt that is elastic such as a rubber belt for example, in the absence of a pressing roller, the belt may stretch to an end side that is lifted by the steering roller. Accordingly, the transfer belt does not contact the steering roller in the entire region of the steering roller 2 in the axial direction. When the pressing roller 15 is provided as in the example image forming apparatus 1, it is possible to better adjust the position of the transfer belt 11 even when an elastic belt is used as the transfer belt 11. In addition, the transfer belt 11 is prevented from lifting, thereby reducing a difference in extension at opposite end portions (or edges) of the transfer belt 11 when the steering roller 2 is tilted.

The cleaning device 170 may remove the toner remaining on the outer peripheral surface 11*s* of the transfer belt 11. When the pressing roller 15 adjusts the charge of the toner remaining on the outer peripheral surface 11*s* of the transfer belt 11, the cleaning device 170 can better remove the toner from the transfer belt 11. For example, when an electrostatic cleaning device is used as the cleaning device 170, the pressing roller 15 can assist an operation of removing the toner by the cleaning device 170 by applying a voltage to the remaining toner and strengthening the charging.

It is to be understood that not all aspects, advantages and features described herein may necessarily be achieved by, or included in, any one particular example. Indeed, having described and illustrated various examples herein, it should be apparent that other examples may be modified in arrangement and detail.

For example, a mechanism in which the steering assembly 50 tilts the steering roller 2 and the pressing roller 15 is not limited to the above-described mechanism, and the steering roller 2 and the pressing roller 15 may be tilted by various other mechanisms.

In addition, the relative position of the pressing roller 15 with respect to the steering roller 2 is not necessarily fixed by the pressing roller holding member 17. For example, the pressing roller 15 may press the transfer belt 11 against the steering roller 2 by biasing the pressing roller 15 via a biasing member such as a spring. As a further example, the pressing roller 15 may press the transfer belt 11 against the steering roller 2 by the weight of the pressing roller 15.

Figure 11:
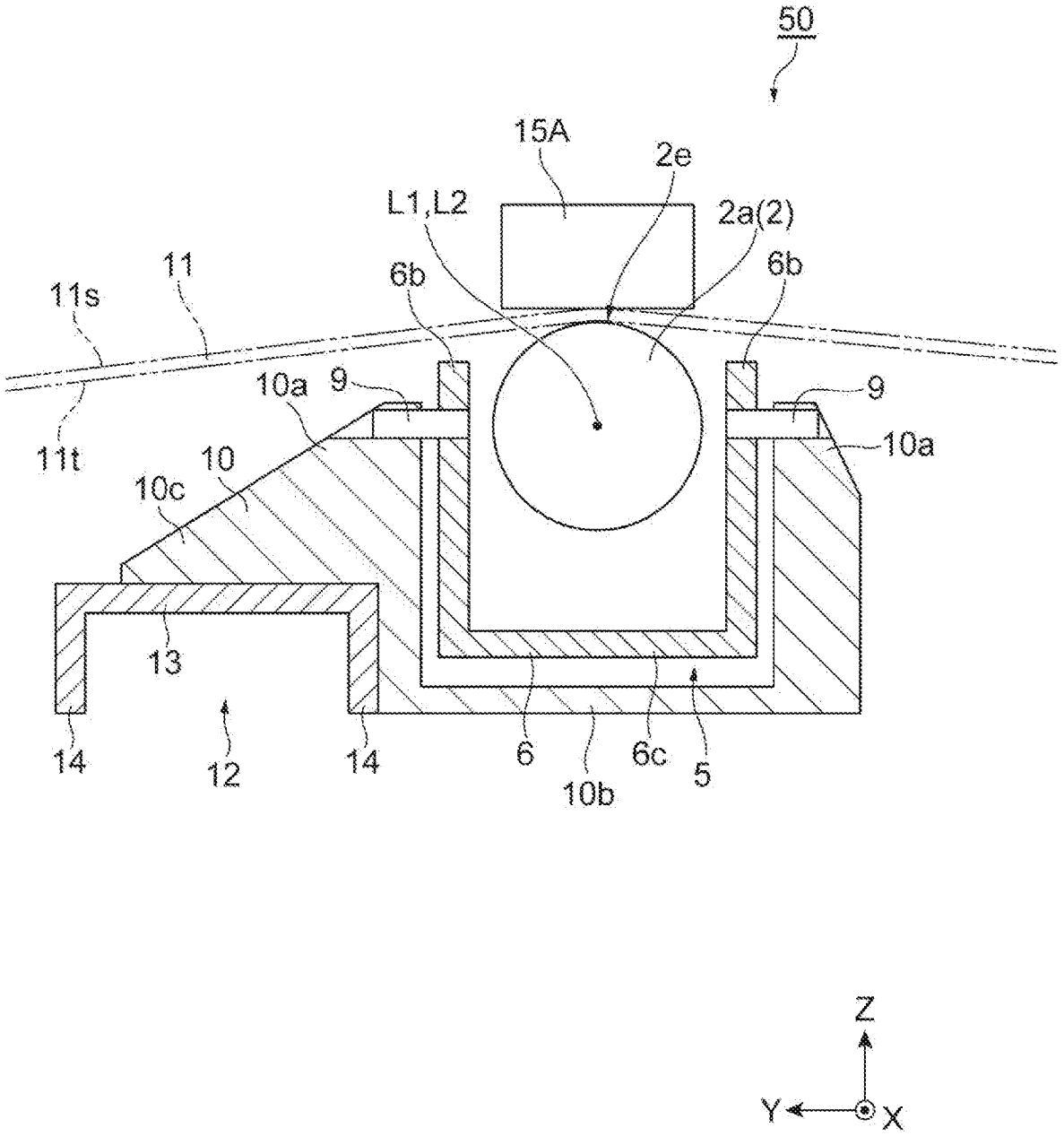
FIG. 11 is a diagram illustrating an example steering assembly including a steering roller.
Figure 12:
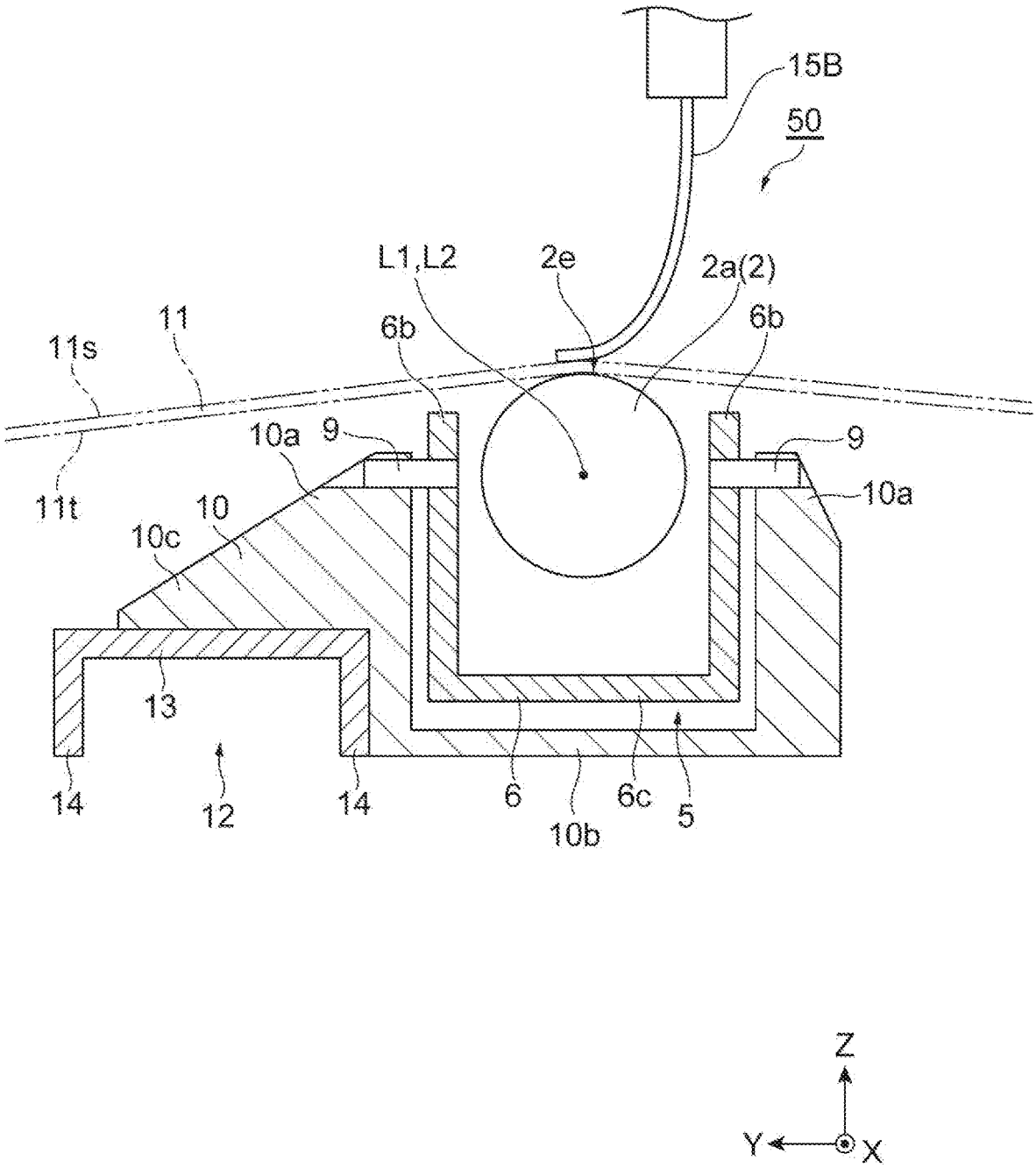
FIG. 12 is a diagram illustrating an example steering assembly including of a steering roller.

In some examples, with reference to FIG. 11, the example image forming apparatus may include a brush (as a second member and a pressing member) 15A. The brush 15A may include a bar brush or a roll brush. In some examples, the example image forming apparatus may include a pad such as an electrostatic pad instead of the brush 15A. In some examples, with reference to FIG. 12, the example image forming apparatus may include a blade member (as a second member and a pressing member) 15B. As the blade member 15B may include a conductive resin or a conductive film.

In some examples, the example image forming apparatus may include a bar-shaped member or the like instead of the steering roller 2.

In some example image forming apparatuses, the steering roller 2 is disposed outside the annular transfer belt 11 and the pressing roller 15 is disposed inside the annular transfer belt 11.

The invention claimed is:

1. An imaging system comprising:

an endless belt having a first surface and a second surface opposite to the first surface; and a steering assembly that is tiltable to adjust a position of the endless belt, wherein the steering assembly includes a first member adjacent the first surface of the endless belt and a second member adjacent the second surface of the endless belt, the second member to press the endless belt against the first member.

2. The imaging system according to claim 1, the first member to tilt, the second member to tilt together with the first member, and the second member to press the endless belt against the first member, via a weight of the second member, via a biasing member to bias the second member, or via a mounting structure that fixes a position of the second member relative to the first member.

3. The imaging system according to claim 1, comprising:

a cleaning device located adjacent the second surface of the endless belt, at a downstream side of the steering assembly in a movement direction of the endless belt, the cleaning device to remove toner from the second surface of the endless belt.

4. The imaging system according to claim 3, wherein the cleaning device includes a cleaning brush to remove the toner.

5. The imaging system according to claim 3, wherein the cleaning device includes a voltage application device to apply a bias voltage of a polarity opposite to the toner.

6. The imaging system according to claim 5, the second member to adjust a charge of the toner on the second surface of the endless belt.

7. The imaging system according to claim 6, the second member to apply a voltage of a same polarity as a polarity of the toner to the toner on the second surface of the endless belt.

8. The imaging system according to claim 1, wherein the first surface faces an inner side of the endless belt, and wherein the second surface faces an outer side of the endless belt.

9. The imaging system according to claim 1, wherein the first member includes a steering roller.

10. The imaging system according to claim 1, wherein the second member includes at least one selected from the group consisting of: a roller, a brush, and a blade member.

11. The imaging system according to claim 1, wherein the first member and the second member are tiltable in a direction intersecting a movement direction of the endless belt.

12. The imaging system according to claim 1, comprising:

a tension system to apply a tension to the endless belt.

13. The imaging system according to claim 12, wherein the tension system includes a drive roller and a tension roller, and wherein the first member and the second member are disposed between the drive roller and the tension roller.

14. An imaging system comprising:

a pair of belt rollers including a first belt roller and a second belt roller;

an endless belt to rotate along circumferential surfaces of the first belt roller and the second belt roller;

a steering roller that is tiltable about a fulcrum to adjust a position of the endless belt; and a pressing member that presses the endless belt against the steering roller, the pressing member to tilt when the steering roller is tilted.

15. The imaging system according to claim 14, wherein the steering roller is located on an inner side of the endless belt, and wherein the pressing member is located on an outer side of the endless belt.

* * * * *